US007837835B2

(12) United States Patent
Nakazawa et al.

(10) Patent No.: US 7,837,835 B2
(45) Date of Patent: Nov. 23, 2010

(54) ON-MACHINE COATER

(75) Inventors: Takeo Nakazawa, Tokyo (JP); Sumio Nakajima, Chiba-ken (JP)

(73) Assignee: Voith Patent GmbH, Heidenheim (DE)

( * ) Notice: Subject to any disclaimer, the term of this patent is extended or adjusted under 35 U.S.C. 154(b) by 730 days.

(21) Appl. No.: 11/697,408

(22) Filed: Apr. 6, 2007

(65) Prior Publication Data

US 2007/0235152 A1 Oct. 11, 2007

(30) Foreign Application Priority Data

Apr. 10, 2006 (JP) ..... 2006-107551

(51) Int. Cl.
*D21H 11/00* (2006.01)

(52) U.S. Cl. ..... 162/265; 118/58

(58) Field of Classification Search ..... 162/265, 162/192; 118/58, 67, 641
See application file for complete search history.

(56) References Cited

U.S. PATENT DOCUMENTS 5,753,078 A * 5/1998 Koutitonsky et al. ..... 162/135
6,284,097 B1 * 9/2001 Wulz et al. ..... 162/137
6,599,395 B2 * 7/2003 Wulz et al. ..... 162/265
2007/0026156 A1 * 2/2007 Mandai et al. ..... 427/402
2009/0324980 A1 * 12/2009 Matsushima ..... 428/537.5

FOREIGN PATENT DOCUMENTS

JP 2006-138045 * 6/2006

* cited by examiner

*Primary Examiner*—Mark Halpern
(74) *Attorney, Agent, or Firm*—Taylor IP, P.C.

(57) ABSTRACT

The present invention simplifies the equipment in an on-machine coater in which a size press and a post-metering style of coater are alternatively used. In an on-machine coater including a size press 3, an air turn 4 arranged diagonally downward on the downstream side of the size press 3, a post-metering style of coater 6 arranged in the downstream side of the air turn 4, and non-contact dryers 11 arranged above the coater 6, when the coating is performed using the size press 3 the two surfaces of a web A are dried by a pair of the non-contact dryers 11 opposingly provided about the diagonally upward-moving web A on the downstream side of the air turn 4. When the coating is performed using the post-metering style of coater 6, the dryer of the pair of non-contact dryers 11 used to dry the lower surface side of the web A is moved in such a way as to oppose the lower surface side of the web A which, beyond the coater 6, moves upward.

3 Claims, 6 Drawing Sheets

ON-MACHINE COATER

BACKGROUND OF THE INVENTION

1. Field of the Invention

The present invention relates to a coating device, and more particularly to an on-machine coater that constitutes a coating device in which the coater and the paper machine are integrated.

2. Description of the Related Art

The production of coated paper such as the printing paper used for catalogues and the like along with pressure-sensitive paper and heat-sensitive paper is based on the coating of application medium, for example paint, using a coater on a web (base material) which serves as the base paper, and the drying therof. Machines that coat application medium, for example paint, in this way are generically referred to as coaters. Commonly employed coaters include blade coaters, rod coaters and air-knife coaters that utilize a post-metering method in which, following the excess coating of application medium, for example paint, on the web, the application medium, for example paint, is either scraped off using a blade or small-diameter rod or blown off using an air-knife and measured (metered).

On the other hand, paper machines, which constitute the machines used to manufacture printing paper and coated base paper or the like, include a head box used to uptake a slurry which constitutes a suspension of pulp or the like and apply it out through a tip-end nozzle, a wire part used to dewater the slurry from the head box to form a paper layer (web), a press part used to pick up and dewater the web from the wire part, and a large number of cylinders that are heated by steam, as well as a dryer part in which the web from the press part is pushed against these cylinders to afford the drying thereof, a large number of vertically-stacked cast iron rollers, a calender for smoothing the web from the dryer part, and a reel around which the web from the calender is wound.

The formation of the paper produced by a paper machine into a coated paper normally involves the use of an on-machine coater. That is to say, the paper roll wound around the reel of the paper machine is mounted on an unwinder of the on-machine coater, and the web pulled from the unwinder is coated by way of a coater. The web coated by the coater is dried by both a non-contact dryer and a cylinder dryer and wound around a reel. Gloss is imparted to the web wound around the reel by way of a supercalender.

Although paper manufacture and coating are normally performed using separate machines, devices in which the paper machine and coater are integrated and from which the reel of the paper machine and the unwinder of the coater are omitted, which are generically referred to as on-machine coaters, are sometimes employed.

FIG. 1 of the drawings is a front view of one example of an on-machine coater. The symbol 1 in the diagram denotes a dryer part (dryer cylinder) provided in the final stage of a paper machine. The symbol 2 denotes a smoothing press (calender) used to smooth a web A, and the symbol 3 denotes a size press. Although the size press, which is normally arranged along the dryer part of the paper machine, is predominantly used for the coating of starch or the like on the web to improve the printability of the paper, it is sometimes arranged in the on-machine coater and used for the coating of a pigment application medium, for example paint, of clay or the like.

FIGS. 2A and 2B show front views of a size press arranged in the on-machine coater disclosed by "Technology Annual Machines•Materials•Pharmaceuticals Conspectus 2006", Pulp and Paper Technology Times, Published 1 Sep. 2005, Vol. 48 No. 9, pages 128-129. When the size press is used for the coating of a pigment application medium, for example paint, the coated amount is 5 to 10 g/m$^2$ per surface, the speed is 1000 to 2000 m/min, and the nip pressure is 30 to 60 kg/cm. FIG. 2A illustrates coating being simultaneously performed on the two surfaces of the web A, and FIG. 2B illustrates the separate implementation of coating on the two surfaces of the web A. Although, when the size press of a paper machine is used for the coating of starch or the like on the web, a starch pond, through which the web is passed therethrough and coated therewith, is formed on the upper part of the nip, when the size press is used for the coating of a pigment application medium, for example paint, of clay or the like, the coating is ordinarily performed by the formation of a pigment film on rollers and then transferred therefrom on to the web A. It should be noted that elements of these diagrams that are common to FIG. 1 are denoted using the same reference symbols.

An additional description with reference to FIG. 1 is given hereinafter. The symbol 4 in FIG. 1 denotes an air turn. The purpose of the air turn 4, which is arranged in a roller part that is readily soiled by the application medium, for example paint, is to improve the quality of the coated surface and prevent stoppage of the machine due to soiling. A high-pressure flotation system is used to non-contactingly alter the movement angle of the web A. The air turn, which has a circular arc-shaped surface, jets air from an air hole provided in its surface to form a film of air between itself and the web A that passes by this surface. The symbol 4*c* denotes a carrier rope sheave. Although carrier ropes are ordinarily used to carry the web through the dryer part of a paper machine, they may also be used to carry the web through an on-machine coater. A carrier rope includes a group of two ropes that pass along a route identical to the path of the web, the web being carried with the tip-ends of selvedges (strips of thickness of the order of 100 mm that are cut off by a water nozzle of the wire part of the paper machine) formed in the operation side of the web being held between and pulled by said group of ropes. When the carry of the web using these strips is completed the water nozzle is actuated to afford an overall increase in width.

The symbol 5 denotes an infrared dryer that constitutes one type of non-contact dryer. The two surfaces of the web A are dried by a pair of infrared dryers 5 opposingly provided in the downstream side of the air turn 4 about the upward-moving web A. The infrared dryers, who afford the non-contact drying of the web, are of either an electrical or a gas type. The advantage of the gas type over the electrical type lies in its much cheaper running costs. The gas infrared dryer combusts a fuel gas that heats a ceramic emitter to a temperature of 110° C. or above which then emits infrared rays on to the web A.

The symbol 6 denotes a blade coater which constitutes one type of a post-metering style of coater for coating the lower surface of the web A. The coated amount is 5 to 15 g/m$^2$ per surface, and the speed is 1000 to 2000 m/min. The blade coater 6, which includes a backing roll 6*a* and coater head 6*c*, sprays an excess amount of application medium, for example paint, upward on to the web A wound around the lower surface of the back up roller 6*a*, and this is then scraped off and measured (metered) using a steel blade. The scraped-off application medium, for example paint, is re-circulated. The symbol 5*a* denotes an infrared dryer used to dry the surface coated by the blade coater.

The symbol 7 denotes an air dryer which constitutes one type of non-contact dryer. The web A is non-contactingly conveyed and dried by way of an air jet. The symbols 8 and 10 denote dryer cylinders, the cylinders of larger diameter being heated by a blown-in steam. The symbols 8*a* and 10*a* denote canvases that are used to push the web A against the cylinders.

FIG. 3 is an expanded view of the middle section of FIG. 1. In FIG. 3, the size press 3 for coating the two surfaces of the web A and the blade coater 6 for coating the lower surface of the web A are used alternatively. When the size press 3 is used the web A is passed along the path shown by B in the diagram, and when the blade coater 6 is used the web A is passed along the path shown by C in the diagram. As shown in the diagram, along path B the web rises directly up from the air turn 4 passing through the infrared dryers 5 used to dry the two surfaces thereof whereupon, by way of an air turn 4A and paper roller d, it passes air turns 4C, 4D before reaching a furthermost upstream air dryer 7*a*. While along path C it is guided by a paper roller e from the air turn 4 to pass below the blade coater 6 where its lower surface is coated whereupon, while rising therefrom, it passes an infrared dryer 5*a* where its coated surface is dried before, passing the air turns 4C, 4D, reaching the furthermost upstream air dryer 7*a*. It should be noted that, in order to coat the upper surface of the web A, as shown by the path D of FIG. 1, the web A is led below the blade coater 6 by a plurality of paper rollers g whereupon, after rising therefrom, it is moved upstream in the reverse direction to where the upper surface of the web A is coated by the blade coater 6, following which it rises to where the coated surface of the web A is dried by the infrared dryer 5A before, by way of air dryers 7A, 7B, reaching the dryer cylinder 8.

As is described above, in a conventional on-machine coater as shown in FIG. 1 and FIG. 3, the size press 3 and the blade coater 6 for coating the lower surface of the web A are used alternatively, and while the web A passes along the path shown by B in FIG. 3 when the size press 3 is used, the web A passes along the path shown by C in FIG. 1 when the blade cover 6 is used. Because the path B and the path C of the web A are so different, the following problems are inherent thereto. First, because the coated surface of the two surfaces of the web A coated by the size press 3 are dried by the infrared dryers 5 and the coated surface of the lower surface side of the web A coated by the blade coater 6 is dried by the infrared dryer 5*a*, the equipment costs, maintenance costs and space for the provision thereof are unavoidably replicated. Reviewing the arrangement of the machine it is clear that it should be possible to contrive the path of the web A to facilitate the combined use thereof. Second, a carrier rope must be provided for each of path B and path C of the web A. By way of example, in a design in which two each, making a total of four, is provided in the operation side, interference problems arise between the web-carrying ropes. Although, as another method, the provision thereof in each of the end surface of an operation-side roller and the end surface of a drive-side roller has been considered, there are inherent dangers associated with the provision of a carrier rope in the drive side. Furthermore, although the cutting of the used web-carrying rope and provision of a new web-carrying rope each time the coated part is changed has also been considered, the operation that this involves is troublesome and, in addition, it is difficult from the viewpoint of both the maintenance of the web-carrying ropes and the increased amount of equipment and so on.

What is needed in the art is to facilitate improved web carry and, in addition, to avoid the replication of equipment (non-contact dryer).

SUMMARY OF THE INVENTION

The present invention provides an on-machine coater including: a size press, arranged in such a way that a straight line connecting the center line of a pair of rollers provided about a continuously diagonally downward-moving web is essentially orthogonal to the web, the size press being used to coat the two surfaces of a web; an air turn, arranged diagonally downward on the downstream side of said size press, the air turn being used to change the direction of movement of the web without contacting the web by way of an air film that is formed between itself and the moving web; a post-metering style of coater, arranged in the downstream side of said air turn, the coater being used to coat the lower surface of the web; and non-contact dryers, arranged above said coater, the dryers being used to dry the web following coating. The coating performed using the abovementioned size press constitutes an alternative to the coating performed using the abovementioned post-metering style of coater. When the coating is performed using the abovementioned size press, the two surfaces of the web are dried by a pair of the abovementioned non-contact dryers opposingly provided on the downstream side of the abovementioned air turn about the diagonally upward-moving web. When the coating is performed using the abovementioned post-metering style of coater, the dryer of the abovementioned pair of non-contact dryers used to dry the lower surface side of the web is moved in such a way as to oppose the lower surface side of the web which, beyond the abovementioned coater, moves upward.

The abovementioned non-contact dryer used to dry the lower surface side of the web can be supported by a pair of arms that turn about a fulcrum provided thereabove, the abovementioned movement being a result of the turning of the arms.

A post-metering style of coater is arranged in the downstream side of an air turn arranged diagonally below on the downstream side of a size press. When the coating is performed using the abovementioned size press, the two surfaces of the web are dried by a pair of the abovementioned non-contact dryers opposingly provided on the downstream side of the abovementioned air turn about the diagonally upward-moving web. When the coating is performed using the abovementioned post-metering style of coater, the dryer of the abovementioned pair of non-contact dryers used to dry the lower surface side of the web is moved in such a way as to oppose the lower surface side of the web which, beyond the abovementioned coater, moves upward. The use of part of the non-contact dryers can be combined to afford an economization of each of the equipment costs, maintenance costs and the space for the provision thereof and the like. Furthermore, by virtue of the fact that there is no significant difference between the length of the path of the web when the coating is performed using the abovementioned size press compared to when the coating is performed using the abovementioned post-metering style of coater, where two are used, the need to replace a carrier rope is eliminated and they need only be re-mounted. The re-mounting of a carrier rope need only involve the use of hoist equipment to establish, by way of example, the backing roll of the post-metering style of coater in a slightly floated state.

As is described above, the use of part of the non-contact dryers can be combined to afford an economization of each of the equipment costs, maintenance costs and the space for the provision thereof and the like, and the re-mounting of the carrier rope used for carrying the web is simple.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
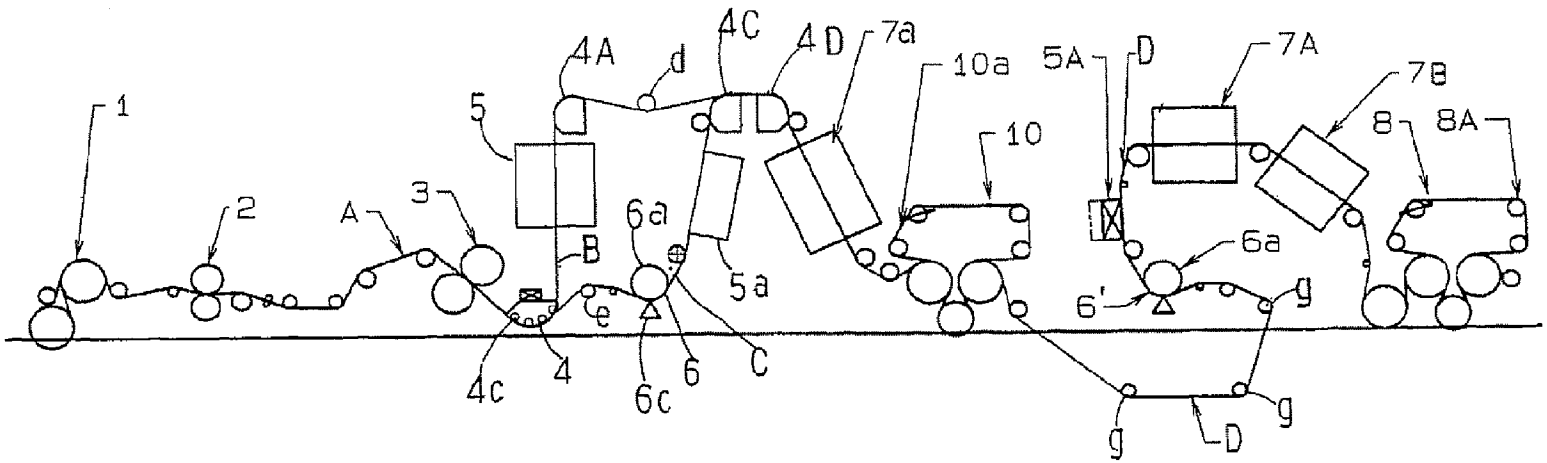
FIG. 1 (PRIOR ART)
FIG. 1 is a front view of one example of a conventional on-machine coater.
Figure 2A:
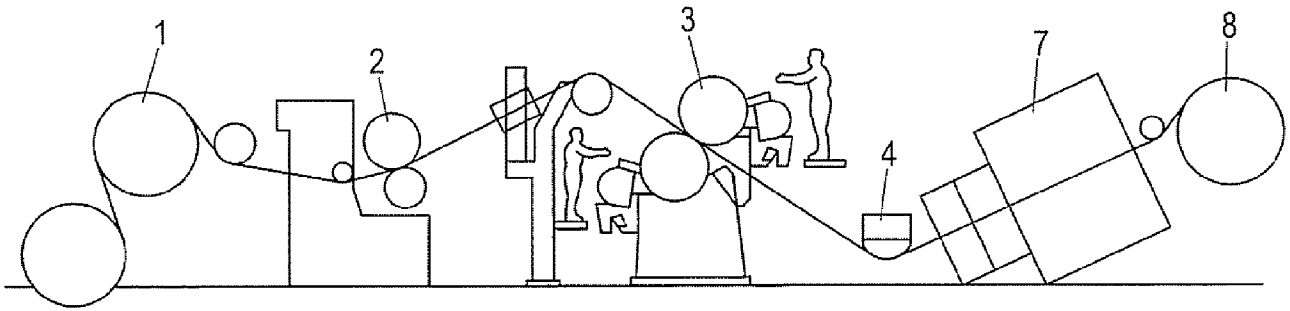
FIG. 2A (PRIOR ART)
FIGS. 2A and 2B show front views of a size press arranged in a conventional on-machine coater.
Figure 2B:
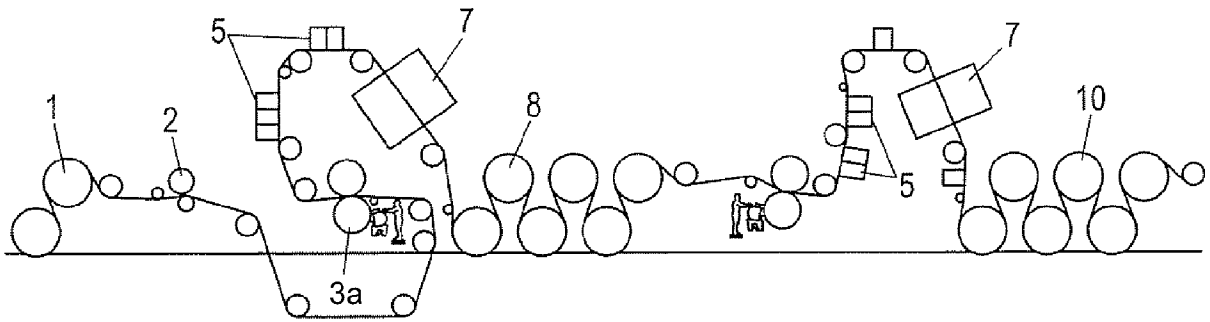
FIG. 2B (PRIOR ART)
Figure 3:
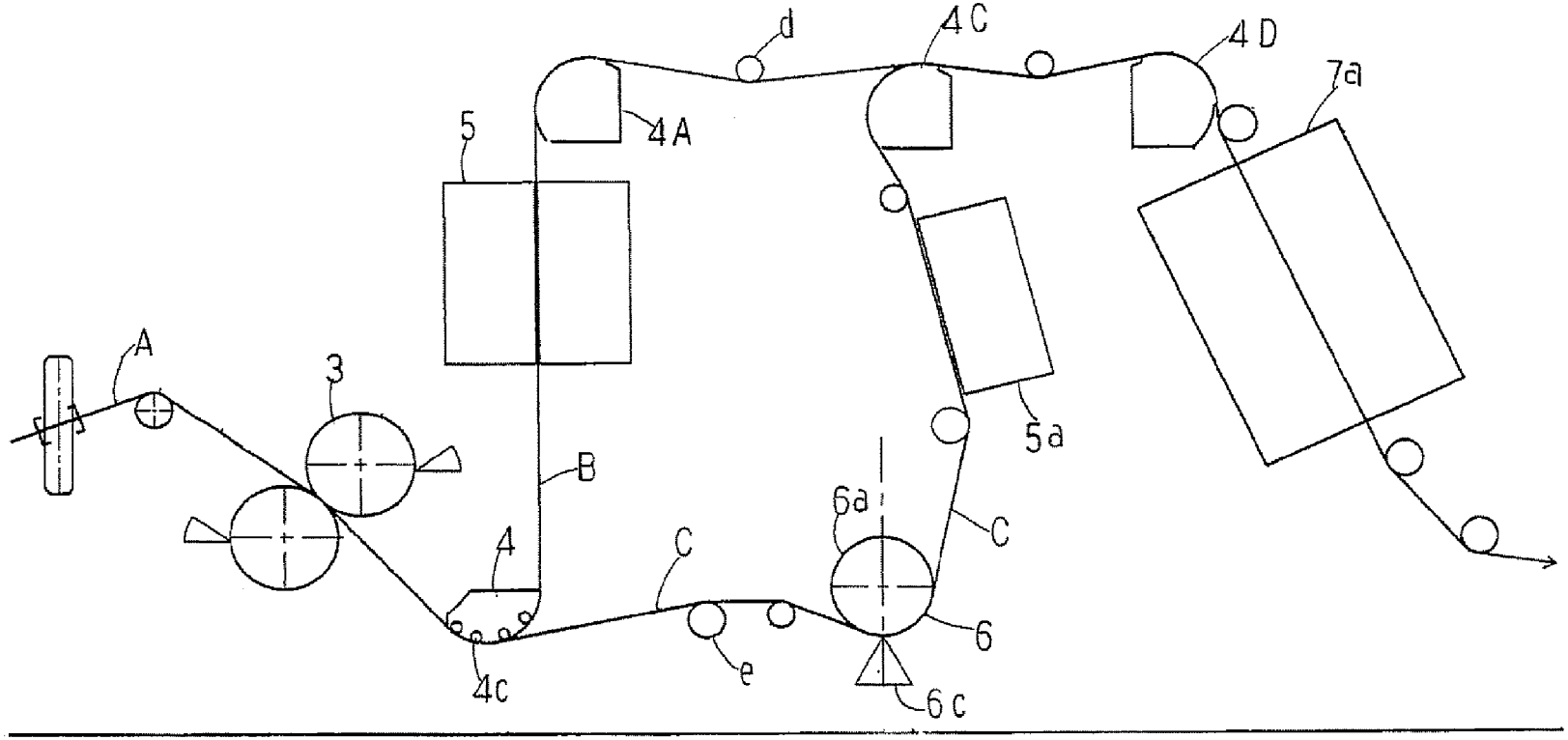
FIG. 3 (PRIOR ART)
FIG. 3 is a partially expanded view of FIG. 1.
Figure 4:
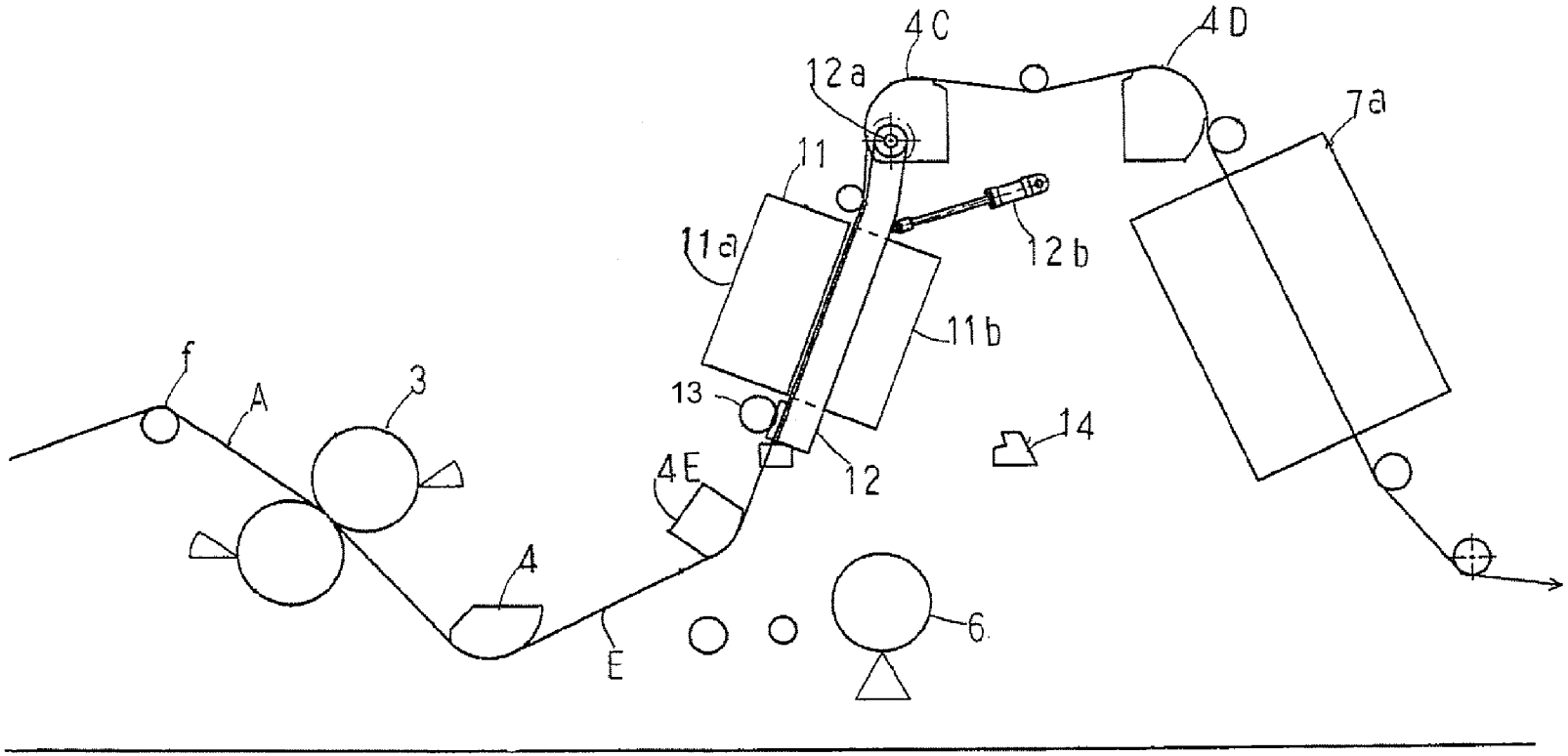
FIG. 4 is a front view of the main part of an on-machine coater of the present invention showing the arrangement of the machine and the path of the web when the coating is performed using a size press.

Referring now to the drawings, and more particularly to FIG. 4, there is shown, in an on-machine coater of the present invention, the arrangement of the machine and path of the web when coating is performed using the size press 3. As is shown in the diagram, the size press 3, which includes a pair of rollers provided about a web that moves continuously diagonally-downward from a paper roller f provided diagonally upward on the upstream side, is arranged in such a way that a straight line connecting the center line of the pair of rollers is essentially orthogonal to the web A. The size press 3 performs coating on the two surfaces of the web A. An air turn 4 that changes the direction of the movement of the web without contacting the web by way of an air film formed between itself and the moving web is provided diagonally downward on the downstream side of the size press 3. The path of the web A when coating is performed using the size press 3 is shown in the diagram by E. As is shown in the diagram, the path E of the web A turns diagonally upward from the air turn 4 and rises at an angle of even steeper gradient beyond a subsequent air turn 4E whereupon, by way of a paper roller 13, enters a pair of infrared dryers 11 opposingly provided about the web A used to dry the two surfaces of the web A. Leaving the infrared dryer 11, the web A passes by way of a paper roller, air turn 4C and air turn 4D before entering an air dryer 7*a* where it is further dried. It should be noted that the devices to the front and rear of the devices shown in FIG. 4 are essentially identical to those of FIG. 1.

The infrared dryer 11 is configured from an infrared dryer 11*a* used to dry the upper surface of the web A and an infrared dryer 11*b* used to dry the lower surface of the web A. The infrared dryer 11*a* is fixed while the infrared dryer 11*b* is of a movable type. The symbol 12 denotes a pair of arms provided on the operation side and the drive side of the machine that support the infrared dryer 11*b* and which turn about a fulcrum 12*a* provided thereabove to move the infrared dryer 11*b*. The symbol 12*b*, which denotes a turning device for turning the arm 12, uses an electromotive jack. A paper roller 13 is provided in the tip-end of the arms 12.

Figure 5:
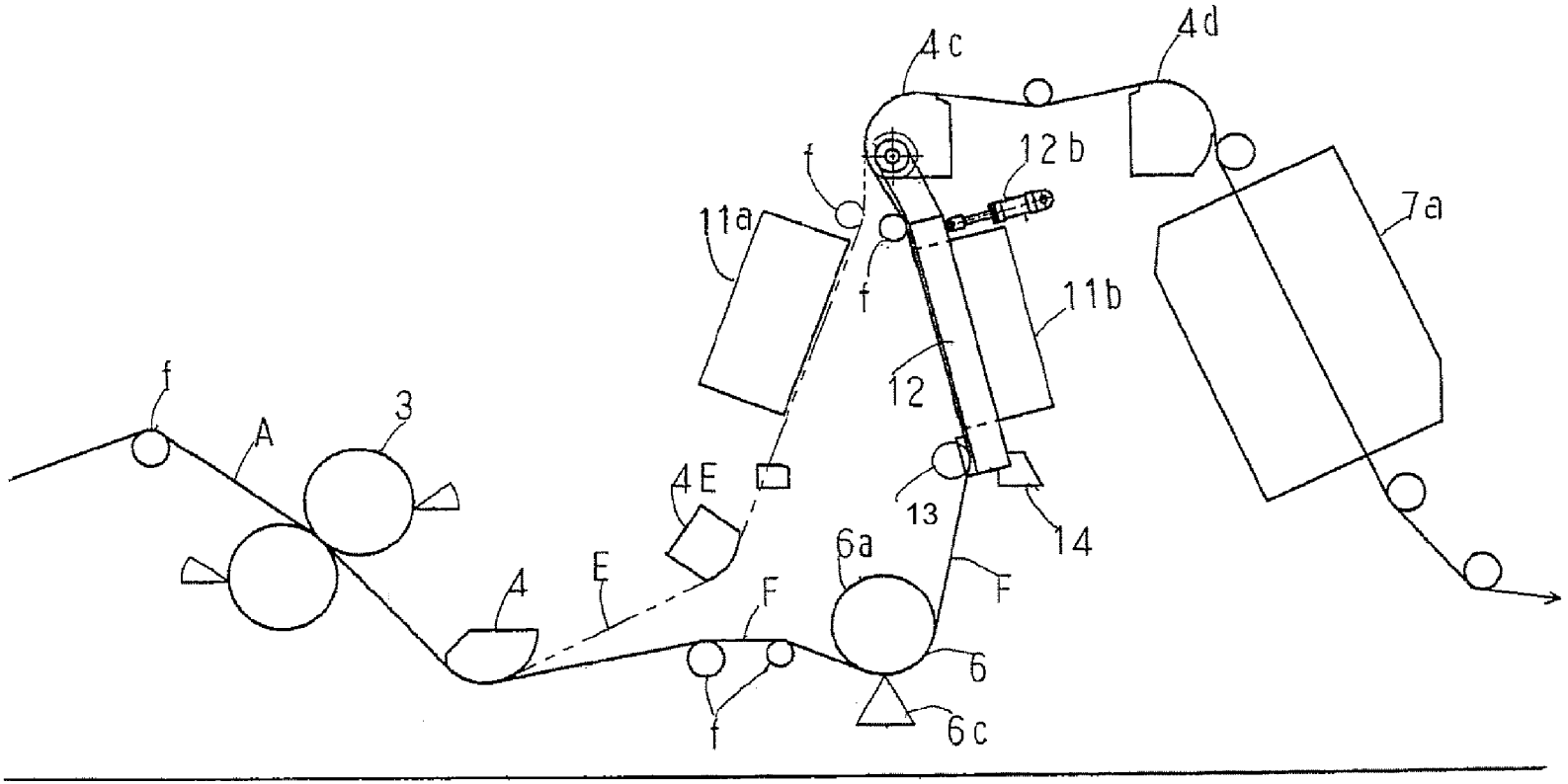
FIG. 5 is a front view of the main part of the on-machine coater showing the arrangement of the machine and the path of the web when the coating of the lower surface of the web is performed using a post-metering style of coater (in this embodiment, a blade coater)

FIG. 5 shows, in the on-machine coater of the present invention, the arrangement of the machine and the path of the web when the lower surface of the web A is coated by a blade coater 6. The blade coater 6 is arranged on the downstream side of the air turn 4. When the coating is performed using the blade coater 6, the infrared dryer 11*b* used to dry the lower surface side of the web A of the infrared dryers 11 is moved in such a way as to oppose the lower surface side of the web which, beyond the blade coater 6, moves upward. The path of the web A when the coating is performed using the blade coater 6 is shown by F. As shown in the diagram, the path F of the web A turns slightly diagonally upward from the air turn 4 and thereafter, by way of two paper rollers f, f, turns slightly downward to be wound around a backing roll 6*a* of the blade coater 6 whereupon, in this state, the lower surface of the web A is coated by a coater head 6*c*. Beyond the blade coater 6, the web A moves upward whereupon, by way of the paper roller 13, a slight shift in direction of movement in the upstream direction occurs. At this time, the infrared dryer 11*b* used to dry the lower surface of the web A is moved to a state in which, in such a way to oppose the lower surface side of the moving web A, it is supported by the arms 12 turned in the counterclockwise direction. The web A, beyond the infrared dryer 11*b*, passes by way of the paper roller f into the air turn 4C. Thereafter it moves in the same manner as described with reference to FIG. 4. The symbol 14 constitutes a stopper for regulating the movement of the arms 12.

Figure 6A:
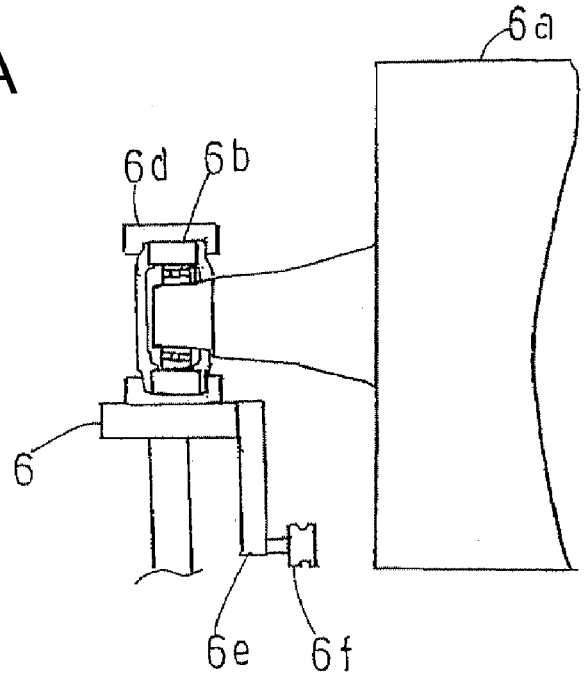
FIG. 6A is a partial side cross-sectional view of the re-mounting of a carrier rope in a blade coater.
Figure 6B:
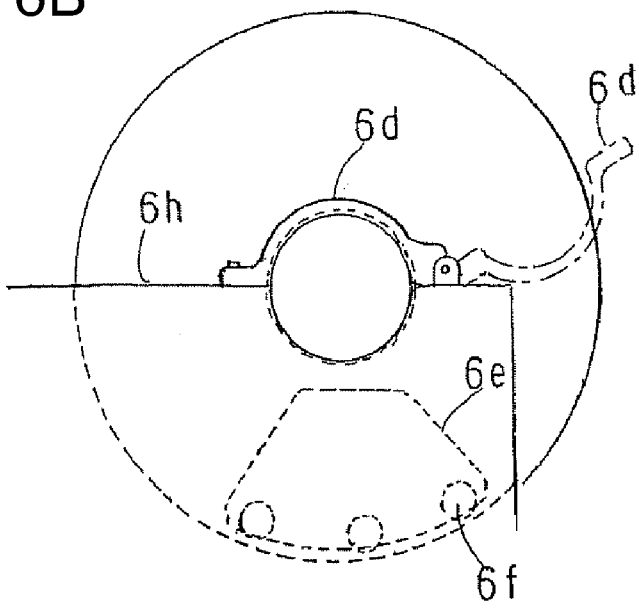
FIG. 6B is a front view of the re-mounting of a carrier rope in a blade coater.

A description of the re-mounting of the carrier rope will be given hereinafter with reference to FIGS. 6A and 6B. FIG. 6A is a side cross-sectional view, and FIG. 6B is a front view thereof. The path of the carrier rope must be the same as the path of the web A. That is to say, when the path of the web A is E, the path of the carrier rope must also be E, and when the path of the web A is F, the path of the carrier rope must also be F. Accordingly, when the path of the web A is altered, the carrier rope must be re-mounted. A description of one example in which the path of the carrier rope is changed from F to E will be given hereinafter.

In FIGS. 6A and 6B, the symbol 6*a* denotes a backing roll of the blade coater 6. The symbol 6*b* denotes a bearing housing for the backing roll 6*a*, 6*h* denotes a support frame, 6*d* denotes a cap for fixing the bearing housing 6*b*, 6*e* denotes a bracket for supporting a rope sheave, and 6*f* denotes the rope sheave. Although, when the path of the carrier rope is F, the carrier rope is provided in a mounted state in the rope sheave 6*f*, when the carrier rope is to be re-mounted in order to change the path of the carrier rope to E, a journal bearing of the backing roll 6*a* forms an obstruction. Thereupon, the cap 6*d* is opened as shown by the broken line in the diagram and, with the backing roll 6*a* in a slightly floated state using hoist equipment not shown in the diagram, a small gap is formed between the bearing housing 6*b* and the support frame 6*h* whereupon, through this gap, the carrier rope need only be removed from the blade coater 6 and re-mounted.

A description of the action of this embodiment is given hereinafter. The blade coater 6 is arranged in the downstream side of the air turn 4 arranged diagonally downward on the downstream side of the size press 3. When the coating is performed using the size press 3, the two surfaces of the web A are dried by a pair of the non-contact dryers 11 opposingly provided on the downstream side of the air turn 4 about the diagonally upward-moving web A. When the coating is performed using the abovementioned post-metering style of coater 6, the dryer 11*b* of the abovementioned pair of non-contact dryers 11 used to dry the lower surface side of the web is moved in such a way as to oppose the lower surface side of the web A which, beyond the abovementioned blade coater 6, moves upward. The use of part of the non-contact dryers 11 can be combined to afford an economization of each of the equipment costs, maintenance costs and the space for the provision thereof and the like. Furthermore, by virtue of the fact that there is no significant difference between the length of the path of the web when the coating is performed using the size press 3 compared to when the coating is performed using the blade coater 6, where two are used the need to replace a carrier rope is eliminated and it need only to be re-mounted. The re-mounting of the carrier rope need only involve the use of hoist equipment to establish, by way of example, the backing roll 6*a* of the blade coater 6 in a slightly floated state.

As is described above, the use of part of the non-contact dryers can be combined to afford an economization of each of the equipment costs, maintenance costs and the space for the provision thereof and the like, and the re-mounting of the carrier rope used for carrying the web is simple.

The present invention is not restricted to the embodiments described above, and it should be understood that various changes may be made thereto within a range that does not depart from the gist of the invention. By way of example, although the non-contact dryers described in the specification are infrared dryers, air dryers may be used. In addition, although the post-metering style of coater described in the specification is a blade coater, an air-knife coater may be used.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Explanation of Symbols

3 Size press

3*a* Part of size press 3

4 Air turn

6 Blade coater

11 Infrared dryer

12 Turning arm

A Web

What is claimed is:

1. An on-machine coater, comprising:

a size press including a pair of rollers, said size press arranged such that a straight line connecting a center line of said pair of rollers provided about a continuously diagonally downward-moving web is essentially orthogonal to said web, said size press used to coat two surfaces of said web;

an air turn arranged diagonally downward on a downstream side of said size press, said air turn used to change a direction of movement of said web without contacting said web using an air film formed between said air turn and said moving web;

a post-metering style of coater arranged in a downstream side of said air turn, said coater used to coat a lower surface of said web; and a plurality of non-contact dryers arranged above said coater, said plurality of non-contact dryers used to dry said web following coating, a coating performed using said size press constituting an alternative to a coating performed using said post-metering style of coater, said two surfaces of said web, when said coating is performed using said size press, being dried by a pair of said plurality of non-contact dryers opposingly provided on said downstream side of said air turn about said web which is diagonally upwardly-moving, one dryer of said pair of said plurality of non-contact dryers, when said coating is performed using said post-metering style of coater, being used to dry a lower surface side of said web, said one dryer being moved in such a way as to oppose said lower surface side of said web which, beyond said coater, moves upward.

2. The on-machine coater according to claim 1, wherein said one non-contact dryer used to dry said lower surface side of said web is supported by a pair of arms that turn about a fulcrum provided thereabove, said one non-contact dryer being moved by a turning of said pair of arms.

3. The on-machine coater according to claim 1, wherein said plurality of non-contact dryers is a plurality of infrared dryers.

* * * * *